United States Patent [19]

Howard

[11] 3,978,993

[45] Sept. 7, 1976

[54] VERTICALLY ADJUSTABLE PIPE RACKING APPARATUS

[75] Inventor: James A. Howard, Houston, Tex.

[73] Assignee: Byron Jackson, Inc., Long Beach, Calif.

[22] Filed: June 24, 1975

[21] Appl. No.: 589,830

Related U.S. Application Data

[63] Continuation of Ser. No. 433,331, Jan. 14, 1974, abandoned.

[52] U.S. Cl. ..... 214/2.5; 175/85; 214/1 P

[51] Int. Cl.[2] ..... E21B 19/00

[58] Field of Search ..... 214/1 P, 2.5, 15 R; 175/85

[56] References Cited

UNITED STATES PATENTS 3,280,920 10/1966 Scott ..... 214/2.5

3,561,811 2/1971 Turner ..... 214/2.5

*Primary Examiner*—Robert J. Spar
*Assistant Examiner*—George F. Abraham
*Attorney, Agent, or Firm*—John O. Evans, Jr.

[57] ABSTRACT

A multi-stage, well-drilling mast assembly, particularly adapted to mobile drilling platforms, such as drilling vessels, the assembly having a main stage mast and an auxiliary mast, both pivoted to the platform for swinging movements between horizontal and vertical positions. The main stage carries well pipe hoisting equipment, and the auxiliary stage carries rack equipment for vertically storing well pipe, and racker equipment for moving the well pipe between the rack and the center line of the mast assembly. The racker equipment includes an upper racker arm and a lower racker arm, the lower racker arm being vertically adjustable and having a vertically moveable head.

16 Claims, 5 Drawing Figures

VERTICALLY ADJUSTABLE PIPE RACKING APPARATUS

This is a continuation of application Ser. No. 433,331, filed Jan. 14, 1974 now abandoned.

BACKGROUND OF THE INVENTION

Marine and mobile rigs for drilling wells, such as oil and gas wells, are large and bulky. Transport of such rigs and stability are facilitated when the pipe hoisting equipment is incorporated in a mast which can be laid down horizontally to provide a low profile and low center of gravity.

The pipe racking equipment employed in fixed derricks as well as folding masts is also quite bulky and heavy, as well as costly, and adds to the instability and difficulties involved in laying down and raising a mast.

THE PRIOR ART

An example of a pipe racking system applied to a vessel for offshore drilling of wells is shown in U.S. Pat. No. 3,561,811, issued Feb. 9, 1971, for "Well Pipe Racker," in the name of John W. Turner, Jr., and U.S. Pat. No. 3,501,017, issued Mar. 17, 1970, for "Finger Board and Racker Apparatus and Method," to Noal E. Johnson, et al.

An example of a well drilling mast adapted to be laid down and incorporating pipe racking equipment of the same type disclosed in the above-cited Turner, Jr., patent, is shown and described in the pending application for U.S. Pat. filed Oct. 10, 1973, Ser. No. 404,943, for "Multi-Stage Well-Drilling Mast Assembly," to James A. Howard, et al.

Both the fixed derrick and the fold down mast have pipe racking systems for storing a quantity of pipe and drill collars in racks in the derrick or mast and for moving the pipe stands and drill collars between the racks and the center of the derrick when adding or removing stands to and from the well drilling string. Each racking system has an upper racker and an intermediate racker adjacent to upper and lower racks for transferring the pipe stands, as well as a lower racker which is used for other purposes, such as handling well casing, the drilling Kelley or other heavy equipment. Each racker is heavy and costly, and in the case of the fold down mast, adds significantly to the weight supported by the mast section carrying the rackers which must be raised and laid down.

SUMMARY OF THE INVENTION

The present invention provides a well drilling rig, in the form of a derrick or mast, with pipe racking apparatus wherein a single lower racker is employed to do the work of the prior intermediate and lower rackers, as well as other work which might otherwise be done by a separate crane.

In addition, since a single racker assembly replaces two of the prior racker assemblies, the gross weight of the rig is significantly reduced.

More particularly, the invention contemplates the provision of a drilling rig mast or derrick having an upper and a lower pipe rack, an upper racker assembly for manipulating the upper end of stands of drill pipe and drill collars, and a lower pipe racker for manipulating the lower ends of the stands, the lower racker being mounted so as to be vertically shifted or adjusted between a position for racking the pipe and collar stands and a lower position for handling casing, the drilling Kelley or other heavy equipment usually handled by a separate crane.

The invention has applications to the usual fixed derrick but is ideally suited for use in a fold down mast to reduce weight, the vertically adjustable racker being located in the usual open side of the mast opposite the drawworks and being shiftable upwardly to an out-of-the-way position facilitating the movement of pipe into and from the mast from and to the usual horizontal rack which stores the pipe during transport of the mast, while the mast is lying down.

This invention possesses many other advantages, and has other purposes which may be made more clearly apparent from a consideration of the form in which it may be embodied. This form is shown in the drawings accompanying and forming part of the present specification. They will now be described in detail, for the purpose of illustrating the general principals of the invention; but it is to be understood that such detailed description is not to be taken in a limiting sense, since the scope of the invention is best defined by the appended claims.

DESCRIPTION OF THE PREFERRED EMBODIMENT

Figure 1:
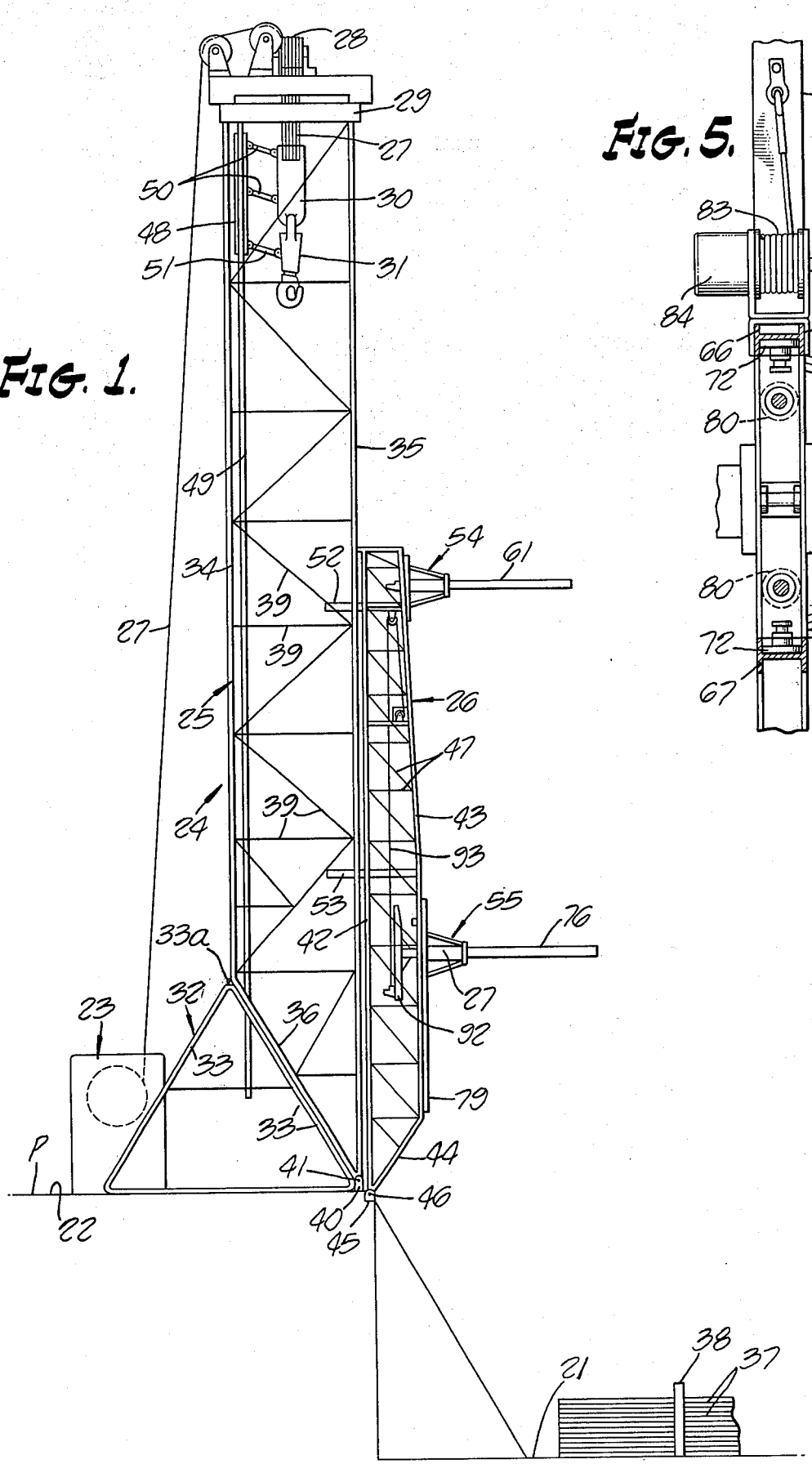
FIG. 1 is a somewhat diagrammatic view in side elevation, showing a fold down drilling mast incorporating the pipe racking apparatus of the invention.
Figure 5:
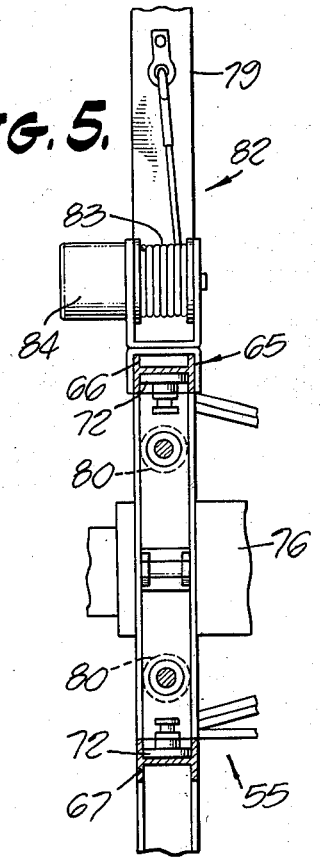
FIG. 5 is a fragmentary detail view in vertical section, showing the hoist mechanism for the vertically shiftable racker.

Referring to the drawings, particularly to FIG. 1, the drilling platform P shown in part may be of a known type and may be part of a vessel afloat on a body of water or a land base portable rig. The platform has a main deck 21 and an elevated drilling floor 22 is erected on the main deck and carries the usual drawworks 23. The floor also serves as a base for and supports a multi-stage drilling mast 24 that embodies the present invention. The mast has a first or main stage 25 and a second or auxiliary stage 26, the mast being shown in the upright or drilling position. A cable 27 leads from the drawworks over a crown block 28, mounted on a water table 29 atop the first stage 25, and thence to a traveling block 30. As is customary, the drilling floor is equipped with a rotary table, not shown, and other drilling equipment usual to rotary drilling rigs, and the drill string, not shown, hangs from the drilling hook 31 and extends to the earth below, all as well known in drilling technology. A supply of drill pipe 37 is contained in a rack 38 on the deck 21.

An A-frame, designated by the general reference numeral 32, is carried by the drilling floor 22. The A-frame has a pair of horizontally spaced, upright, side frames 33, joined by by a horizontal arbor 33*a*.

The first or main stage 25 of the mast is a trusswork structure having upright members or legs at the respective four corners thereof. Two of the upright members 34, one of which is seen in FIG. 1, are at the front of the first stage, and the other two, one 35 of which is seen in FIG. 1, are at the rear. The front upright members 34 have downward extensions 36 bent at an angle to conform to and lie adjacent to the front struts 33' of the A-frame, previously described. The downward extensions 36 are joined to the respective front legs 35 at the bottom of the first stage, and cross braces and sway braces 39 add rigidity and strength to the structure.

A pair of laterally spaced, upstanding clevises 40, one of which is seen in FIG. 1, are secured to the drilling floor 22 to pivotally receive the bottom portions of the first stage, on pivot pins 41, about which the first stage may be swung to vertical and horizontal positions.

The first stage is releasably secured in its upright position by means shown in detail in the aforementioned application of Howard and Smith.

It is seen that the second stage 26 is also a trusswork structure having four upright members or legs at the corners thereof. Two of these legs 42, one of which is seen in FIG. 1, are at the front of the stage, and two 43 are at the rear. Each of the front legs has a downward extension 44 inclined rearwardly and joined to the respective rear legs 42 at their lower ends for pivotal connection with a pair of laterally spaced pivot brackets 45 anchored to the drilling floor 22. Pivot pins 46 are passed through aligned holes in the brackets 45 and the lower ends of the second stage are pivotally mounted on the pins 46 for movement of the second stage between its erect and recumbent positions. Cross-braces and sway braces 47 extend between the legs of the second stage to add strength and rigidity to it.

It is seen that the first or main stage 25 of the multi-stage mast carries the hoisting equipment. This equipment includes not only the crown block 28, previously referred to, but also the traveling block 30 suspended from the crown block by the wirerope cable 27, mentioned hereinbefore. The traveling block is raised and lowered in the first stage by the drawworks 23 to move the drilling string (not shown) into and out of the well, as is conventional. The hook assembly 31 is suspended from the traveling block 30.

Block and hook positioning and guiding apparatus is also provided. In the illustrated embodiment, this apparatus has a carriage 48 vertically movable on a pair of parallel, vertical guide rails 49, only one of which is seen in FIG. 1, affixed to the first stage structure. A pair of vertically spaced, parallel links 50, 50 is pivoted to the carriage and the traveling block, and a third parallel link 51 is pivoted to the carriage and the hook assembly. Motor means, not shown, in the form of a piston-and-cylinder device, one end of which is attached to the carriage and the other end of which is attached to the traveling block, moves the traveling block and hook assembly from a position on the center line of the first stage, which is an extension of the center line of the well, to another position displaced to the rear of the center line, and selectively holds the traveling block and hook assembly in either of such positions. With this apparatus, drill pipe may be handled rapidly in making round trips for the purpose of replacing a worn drill bit, for example. This hoisting apparatus and its method of use are well known, per se, and are more fully disclosed in U.S. Pat. No. 3,507,405, issued Apr. 21, 1970, "Block and Hook Structure Positioning and Guiding Apparatus," Taylor L. Jones, et al., to which reference is made.

It is seen that the second or auxiliary stage 32 of the mast of the invention carries the pipe storage racks and the equipment for racking and unracking the stands of drill pipe and the drill collars, and for transporting them to racked positions and positions over the rotary table and in line with the well bore.

In brief, the pipe storage equipment or rack includes a fingerboard 52 mounted on the second stage near the upper end thereof, a lower rack member 53, and a base not shown on the floor 22. Stands of pipe are received vertically in the rack, with their lower ends resting on the base, their upper ends received in slots (not shown) in the fingerboard 52, and their medial portions embraced in the intermediate rack member 53, as described and shown in the aforementioned Johnson, et al., and Turner patents.

Further, the racker apparatus includes an upper racker 54 and a lower racker 55. The upper racker 54 has a laterally extending, elongate frame mounted on the legs 43 of the second stage 26. This frame provides upper and lower parallel guide rails 56, 57 on which a racker arm carriage 58 is mounted for transverse movement along the guide rails. The carriage is provided with a remotely controlled motor 59 with a sprocket drive engaging a chain 60 which spans the fixed frame for translating the carriage along the rails 56, 57. The racker arm 61 is reciprocably carried in a tubular guide 62 on the carriage and mounted in the guide for forward and backward motion into and out of the first stage 25. The arm is moved in its tubular guide by another remotely controlled motor (not shown). At the inner end of the racker arm is mounted a racker head 63 which, as disclosed in the aforementioned U.S. Pat. No. 3,561,811, may be in the form of a claw for holding the upper end of a well pipe as the carriage 58 and arm 61 move it horizontally from place to place in the first stage 25 by effecting lateral movements of the carriage 58 and inward and outward movements shiftably the racker arm 61.

More particularly, the present invention involves the provision of the lower racker 55 in the derrick or mast. This racker 55 comprises a laterally extended frame 65 comprising upper and lower parallel frame rails 66 and 67 and vertical end frame members 69, 69. These rails 66, 67 and 69 are channel irons. Laterally shifatably supported within the frame work 65 is a carriage 70 supported for movement by the horizontal rails 66 and 67 by rollers 71 which are rotatable on horizontal axes and by rollers 72 which are rotatable on vertical axes engaging within the channel rails 66 and 67. Means are provided for effecting horizontal movement of the carriage 70 within the frame structure 65, including a sprocket drive motor 73 carried by the carriage and engaging a drive chain 74 extending through the carriage and anchored to vertical reinforcing members 75 at opposite sides of the frame. This motor 73, like the motor 59 in the upper racker 54, is remotely controlled.

The racker 55 also includes a horizontally disposed elongated racker arm 76 reciprocably supported within a tubular guide 77 fixedly supported in the carriage 70 by suitable structural members as illustrated. The racker arm 76, like the previously described racker arm 61, is adapted to be moved longitudinally within the guide 77 by a suitable remotely controlled motor means (not shown). The racker head 78 on the inner end of the arm 76 can be moved inwardly and outwardly with respect to the first mast stage 25 for engagement with the length of pipe as shown in full lines in FIG. 2, or can be retracted to the position shown in broken lines in FIG. 2.

The racker frame 65 is also supported for vertical movement. For this purpose the second stage 26 of the mast has vertically extended parallel and opposed channel rails 79 adjacent to its corners 43. Each of the vertical end frame members 69 supports vertically spaced rollers 80 revolvable on horizontal axes, and an intermediate roller 81 revolvable on a horizontal axis, and engageable within the vertically extended channel rails 79. Means 82 are provided for hoisting and lowering the frame 65 between the upper position shown in full lines in FIGS. 2, 3, and 4, and the lower position shown in broken lines in those views. The hoist means 82 comprises a cable drum 83 adapted to be driven by a remotely controlled motor 84 to wind thereon from opposite directions opposite runs 85 and 86 of a hoist cable anchored at its respective ends 87 and 88 on the vertical channel rail 79. The cable drum 83 is located substantially centrally of the frame 65 so as to equally hoist the two sides of the frame 65. The respective runs 85 and 86 extend beneath idler rollers 89 and 90, as best seen in FIG. 4, whereby the cable runs are adapted to lift substantially vertically at the opposite sides of the frame 65.

Figure 3:
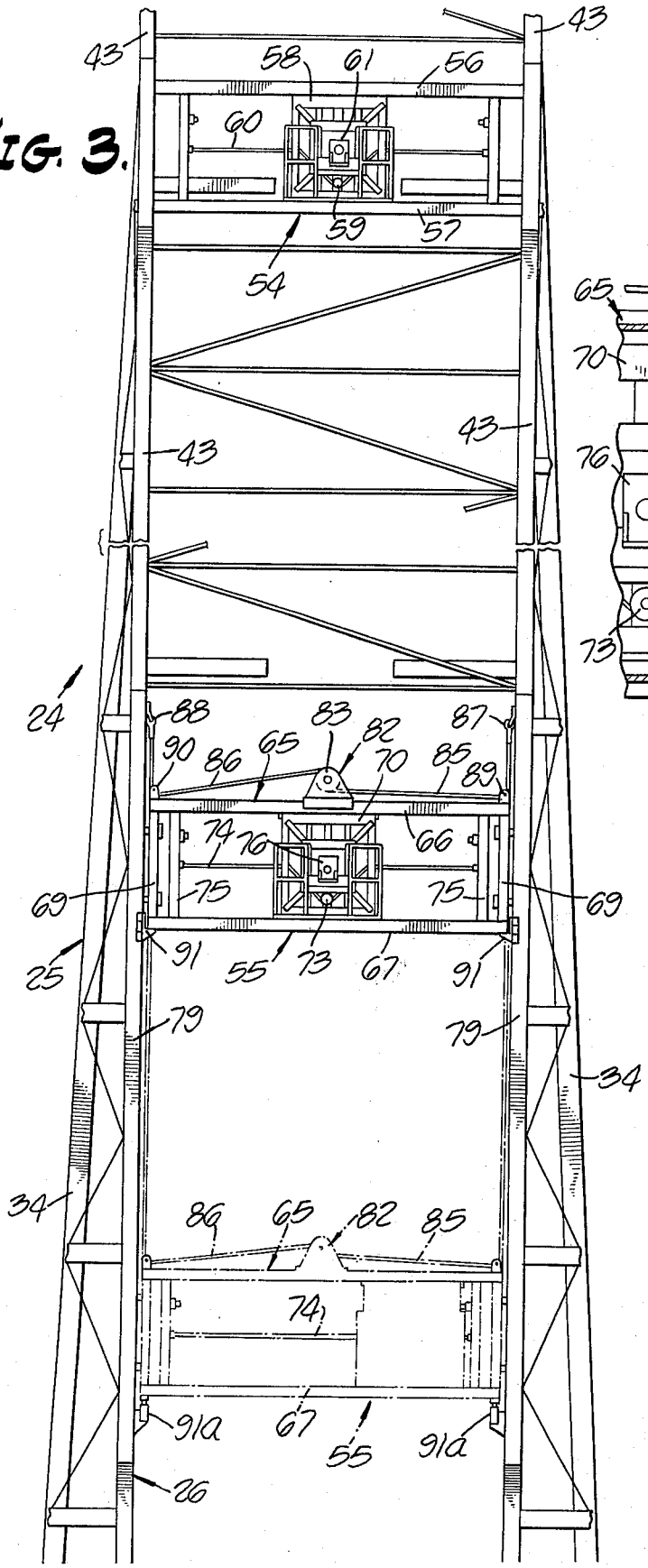
FIG. 3 is an enlarged view in front elevation of the apparatus of FIG. 2.
Figure 4:
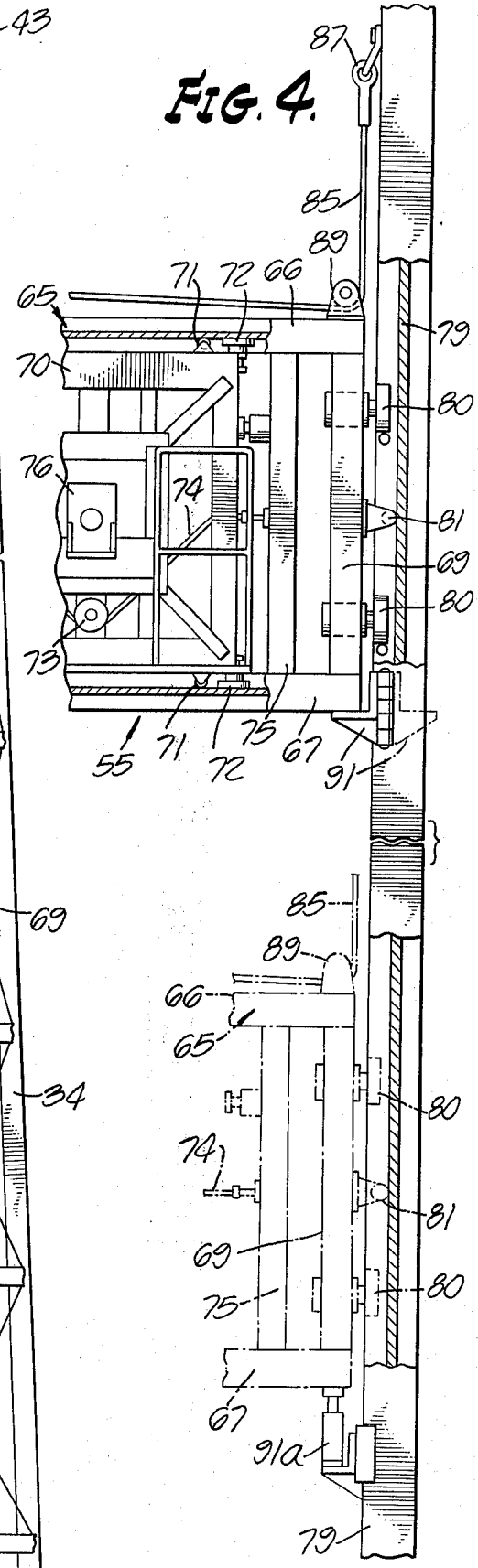
FIG. 4 is a further enlarged fragmentary view illustrating one side mounting for the vertically shiftable racker, showing the racker in full lines retained in its upper position and showing the racker in broken lines in its lowermost position.

In order to support the frame 65 in its uppermost position, again, as best seen in FIG. 4, the vertical side rails 79 hingedly support L-shaped brackets or rests 91 adapted to be pivoted to the frame supporting position shown in full lines in FIGS. 3 and 4, and to the out-of-the-way broken line position in FIG. 4, so that the hoist mechanism 82 need not suspend the racker assembly 55 in its upper position. When the racker assembly 55 is lowered by the hoist mechanism 82 to the lower or broken line position, as seen in FIGS. 3 and 4, the lower frame member 67 abuts at its opposite ends with suitable cushioning stop means 91*a* which may be in the form of spring loaded shock absorbers, so that the hoist mechanism 82 need not suspend the racker assembly 55 in its lowr position.

Figure 2:
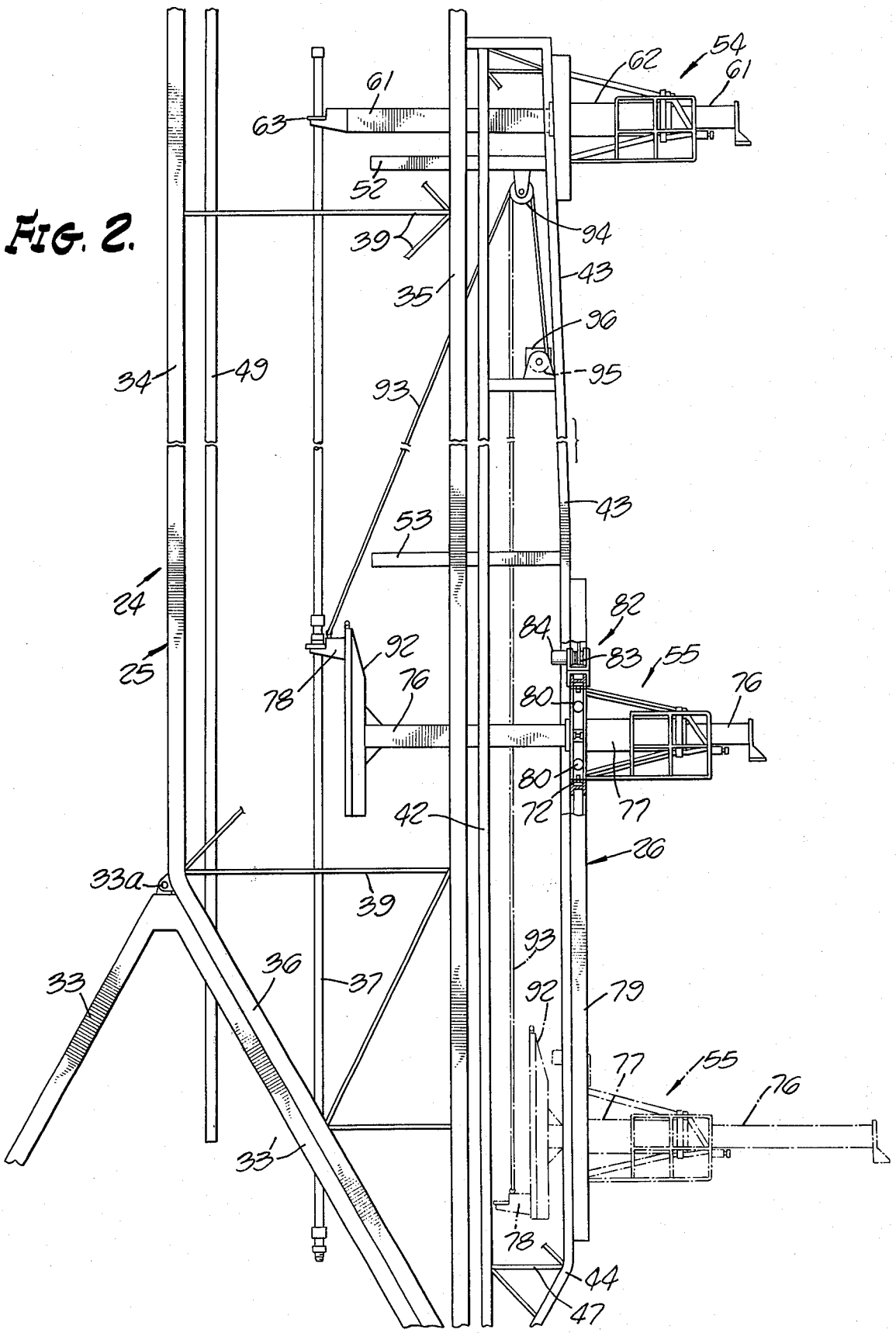
FIG. 2 is an enlarged fragmentary view in side elevation, showing the vertically movable racker in full lines in an upper position, cooperating with the upper racker to handle a stand of pipe, and showing the vertically movable racker in broken lines in a lower and retracted position.

The racker head 78 is also vertically adjustable on a supporting frame structure 92 in a manner more particularly disclosed, for example, in the aforementioned U.S. Pat. No. 3,561,811. The head 78 is vertically guided in the support structure 92 and adapted to be raised and lowered by a hoist cable 93 which extends over a pulley 94 affixed beneath the rack 52 and adapted to be wound on and unwound from a drum 95 powered by a remotely controlled motor 96. In FIG. 2, the rack head 78 is shown in full lines in an elevated position and engaged with a stand of the pipe, as for example, when the pipe is being racked or unracked and being transferred between the center of the first mast stage 25 and the racks 52 and 53. The racker head 78 is shown in a lower position in FIG. 2.

It will be appreciated, inasmuch as the entire racker arm assembly 55 is vertically moveable and the racker head 78 is also vertically moveable, not only can the racker assembly 55, as a whole, be vertically adjusted to enable its use as a crane, but further, the head 78 can be utilized to engage and vertically shift heavy equipment. Moreover, it will be appreciated that because of the vertical adjustability of the racker 55, the need for three rackers, as disclosed in the aforementioned patents, is obviated.

I claim:

1. A well drilling rig comprising: a vertically disposed supporting structure having hoist mechanism therein for raising and lowering a string of drill pipe with respect to the floor of the rig, pipe rack means in said supporting structure at one side thereof for removably storing vertically disposed lengths of pipe, upper pipe racker means carried by said supporting structure, lower pipe racker means carried by said supporting structure and spaced below said upper pipe racker means, each of said pipe racker means including a horizontally disposed racker arm having an inner end provided with a pipe engaging head, means supporting said respective racker arms for horizontal movements to move a length of generally vertically disposed pipe engaged by said heads between the center of said supporting structure and said pipe rack means, motor means for moving said racker arms as aforesaid, means mounting said lower racker means for vertical movement with respect to said supporting structure, and hoist means directly connected to said lower racker means for raising and lowering the latter.

2. A well drilling rig as defined in claim 1, wherein said lower racker means includes a supporting frame for supporting the racker arm of said lower racker means, means mounting said supporting frame in said structure for vertical movements between an upper position and a lower position, and said hoist means is interconnected between said structure and said supporting frame.

3. A well drilling rig as defined in claim 1, wherein said lower racker means includes a supporting frame for supporting the racker arm of said lower racker means, means mounting said supporting frame in said structure for vertical movements between an upper position and a lower position and said hoist means includes a powered cable drum carried by said supporting frame and having opposite cable runs extending from said drum to said supporting structure and connected to the latter.

4. A well drilling rig as defined in claim 1, wherein said lower racker means includes a supporting frame for supporting the racker arm of said lower racker means, means mounting said supporting frame in said structure for vertical movements between an upper position and a lower position and said hoist means includes a powered cable drum carried by said supporting frame and having opposite cable runs extending from said drum to said supporting structure and connected to the latter, and idlers at the sides of said supporting frame, said cable runs extending beneath said idlers and being connected to said supporting structure above said supporting frame.

5. A well drilling rig as defined in claim 1, wherein said lower racker means includes a supporting frame for supporting the racker arm of said lower racker means, means mounting said supporting frame in said structure for vertical movements between an upper position and a lower position and said hoist means includes a powered cable drum carried by said supporting frame and having opposite cable runs extending from said drum to said supporting structure and connected to the latter, and including retractable stop means cooperable between said supporting frame and said supporting structure for releasably supporting said supporting frame in said upper position.

6. A well drilling rig as defined in claim 1, wherein said lower racker means includes a supporting frame for supporting the racker arm of said lower racker means, means mounting said supporting frame in said structure for vertical movements between an upper position and a lower position and said hoist means includes a powered cable drum carried by said supporting frame and having opposite cable runs extending from said drum to said supporting structure and connected to the latter, and including a stop member shiftably carried by said supporting structure and movable to a position beneath said supporting frame for releasably supporting said supporting frame in said upper position.

7. A well drilling rig as defined in claim 1, wherein said lower racker means includes a supporting frame for supporting the racker arm of said lower racker means, means mounting said supporting frame in said structure for vertical movements between an upper position and a lower position and said hoist means includes a powered cable drum carried by said supporting frame and having opposite cable runs extending from said drum to said supporting structure and connected to the latter, and including retractable stop means cooperable between said supporting frame and said supporting structure for releasably supporting said supporting frame in said upper position, and stop means for limiting downward movement of said supporting frame to said lower position.

8. A well drilling rig as defined in claim 1, wherein said supporting structure comprises a pair of vertically disposed laterally spaced opposed channel rails, said lower racker means including a supporting frame for supporting the racker arm of said lower racker means, means mounting said supporting frame between said rails for vertical movements between an upper position and a lower position, and said hoist means is interconnected between said supporting frame and said supporting structure.

9. A well drilling rig as defined in claim 1, wherein said supporting structure comprises a pair of vertically disposed laterally spaced opposed channel rails, said lower racker means including a supporting frame for supporting the racker arm of said lower racker means, means mounting said supporting frame between said rails for vertical movements between an upper position and a lower position, and said hoist means is interconnected between said supporting frame and said supporting structure, said hoist means including a powered cable drum carried by said supporting frame and having opposite cable runs extending from said drum to said supporting structure and connected to the latter.

10. A well drilling rig as defined in claim 1, wherein said supporting structure comprises a pair of vertically disposed laterally spaced opposed channel rails, said lower racker means including a supporting frame for supporting the racker arm of said lower racker means, means mounting said supporting frame between said rails for vertical movements between an upper position and a lower position, and said hoist means is interconnected between said supporting frame and said supporting structure, said hoist means including a powered cable drum carried by said supporting frame and having opposite cable runs extending from said drum to said supporting structure and connected to the latter, and idlers at the sides of said supporting frame, said cable runs extending beneath said idlers and being connected to said supporting structure above said supporting frame.

11. A well drilling rig as defined in claim 8, wherein said means mounting said supporting frame between said rails comprises rollers carried by said frame and engaged with said rails.

12. A well drilling rig as defined in claim 1, wherein said supporting structure comprises a pair of vertically disposed laterally spaced opposed channel rails, said lower racker means including a supporting frame for supporting the racker arm of said lower racker means, means mounting said supporting frame between said rails for vertical movements between an upper position and a lower position, and said hoist means is interconnected between said supporting frame and said supporting structure, and said supporting frame comprising a carriage carried by said supporting frame for lateral movement between said rails, and means for effecting said lateral movement of said carriage.

13. A well drilling rig as defined in claim 1, wherein said supporting structure comprises a pair of vertically disposed laterally spaced opposed channel rails, said lower racker means including a supporting frame for supporting the racker arm of said lower racker means, means mounting said supporting frame between said rails for vertical movements between an upper position and a lower position, and said hoist means is interconnected between said supporting frame and said supporting structure, and said supporting frame comprising a carriage carried by said supporting frame for lateral movement between said rails, and means for effecting said lateral movement of said carriage, said racker arm of said lower racker means having means supporting its pipe engaging head for vertical movement, and also including means for shifting said head vertically.

14. A well drilling rig as defined in claim 1, wherein said racker arm of said lower racker means has means supporting its pipe engaging head for vertical movement, and including means for shifting said head vertically.

15. A well drilling rig as defined in claim 1, wherein said racker arm of said lower racker means has means supporting its pipe engaging head for vertical movement, and including means for shifting said head vertically, said head shifting means comprising a cable connected to said head and extending upwardly in said structure, and means for pulling in and paying out said cable.

16. A well drilling rig as defined in claim 1, wherein said supporting structure comprises a foldable mast assembly including a base support, a first mast stage having said hoist mechanism therein, and a second mast stage having said pipe racker means therein, and means pivotally mounting said first and second mast stages to said base support for movement between adjacent upright and recumbent positions.

* * * * *